US006290303B1

(12) United States Patent
Boucherie

(10) Patent No.: US 6,290,303 B1
(45) **Date of Patent: *Sep. 18, 2001**

(54) METHOD FOR MANUFACTURING BRUSHES AND BRUSH MANUFACTURING MACHINE APPLYING THIS METHOD

(75) Inventor: Bart Gerard Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/352,878

(22) Filed: Jul. 13, 1999

(30) Foreign Application Priority Data

Jul. 14, 1998 (BE) ..... 09800537

(51) Int. Cl.[7] ..... A46D 1/08; A46D 9/06
(52) U.S. Cl. ..... 300/5; 300/11; 300/21
(58) Field of Search ..... 300/4, 5, 7, 8, 300/10, 11, 18, 19, 21

(56) References Cited

U.S. PATENT DOCUMENTS 2,298,156 * 10/1942 Person ..... 300/21
3,026,146 * 3/1962 Szabo et al. ..... 300/21
4,768,837 * 9/1988 Boucherie ..... 300/8
5,033,797 * 7/1991 Rueb ..... 300/21
5,104,196 * 4/1992 Boucherie ..... 300/5
5,454,626 * 10/1995 Schiffer et al. ..... 300/21
5,474,366 * 12/1995 Strutt et al. ..... 300/21
5,518,301 * 5/1996 Boucherie ..... 300/21
5,533,791 * 7/1996 Boucherie ..... 300/5
5,813,728 * 9/1998 Zigerlig ..... 300/21

FOREIGN PATENT DOCUMENTS 0 346 646 A2 12/1989 (EP) .
0 567 672 A1 11/1993 (EP) .

* cited by examiner

*Primary Examiner*—Terrence R. Till
(74) *Attorney, Agent, or Firm*—Bacon & Thomas PLLC

(57) ABSTRACT

A method and device for manufacturing brushes. The device includes at least one carrier (2) with openings (3) which are mutually arranged according to a certain pattern. The fiber bundles (4) are separated laterally from at least one quantity of loose fibers (7). The fiber bundles (4) are inserted in a mechanical manner, step-by-step, in the openings (3) of the carrier (2). An extremity of the fiber bundles (4) are transferred simultaneously in a mechanical manner from the carrier (2) toward a holder (10). The fiber bundles (4) are fixed in at least a portion of a brush body (5) by positioning the extremity of the fiber bundles (4) in a mold, such that the fiber bundles (4) extend through the holder (10). A synthetic material is injected in the mold and form at least a portion of the brush body (5).

18 Claims, 10 Drawing Sheets

Fig. 18
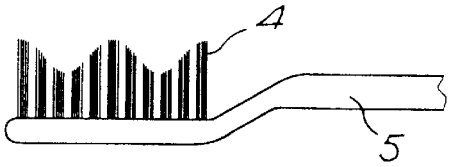
Fig. 19
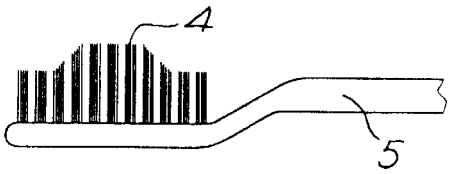
Fig. 20
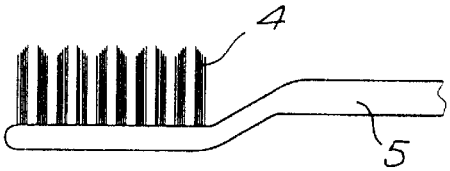
Fig. 21
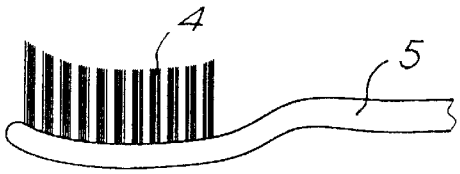
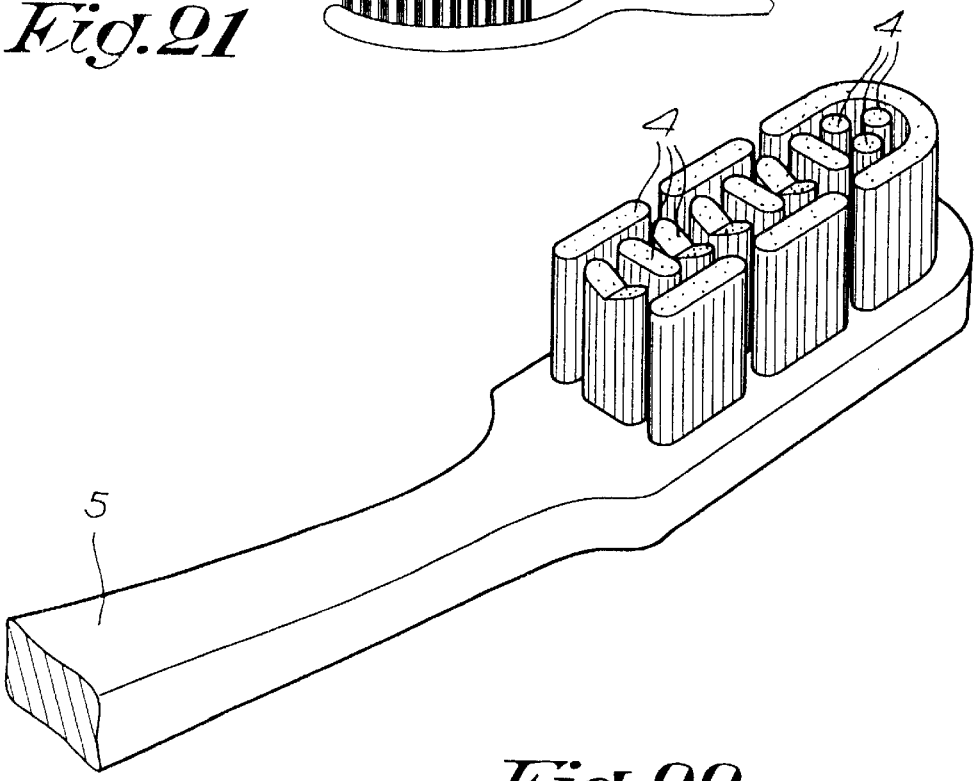
Fig. 22

METHOD FOR MANUFACTURING BRUSHES AND BRUSH MANUFACTURING MACHINE APPLYING THIS METHOD

BACKGROUND OF THE INVENTION

1. Field of the Invention

This invention relates to a method for manufacturing brushes, as well as to a device, more particularly a brush manufacturing machine, applying this method.

2. Description of the Prior Art

For manufacturing brushes, more particularly toothbrushes, substantially two techniques are known.

According to a first known technique, fiber bundles are fixed by means of anchoring plates in openings or holes in a brush body.

A big disadvantage of this technique consists in that it is only possible to work with fiber bundles of a single well-defined diameter, unless one and the same brush is manufactured on different machines.

According to a second known technique, fiber bundles are provided in holes or openings in brush bodies or in a portion of brush bodies, after which the fibers, at the extremities provided in the openings, are mutually connected. In consideration of the fact that no anchoring plates are applied therewith, the shape of the openings in which the fiber bundles are provided may be of any form.

The invention relates to a method which allows the realization of brushes according to the aforementioned second technique in a fast manner, whereby a variety of patterns of fibers to be inserted can be realized in a simple way.

SUMMARY OF THE INVENTION

To this aim, the invention relates to a method for manufacturing brushes, wherein a device is applied consisting of at least one carrier with openings which are mutually arranged according to a certain pattern, whereby the fiber bundles which have to be provided in a brush body can be put in this carrier, and whereby this method further consists in the combination of at least four steps, respectively, the lateral separation of fiber bundles from at least one quantity of loose fibers; the provision, in a mechanical manner, step-by-step, of the aforementioned fiber bundles in the aforementioned carrier; the transfer of the fiber bundles which are placed in the carrier by means of this carrier to a holder; and, by means of this holder, the fixation of the fiber bundles in the brush body, or at least in a portion of the brush body, whereby this is realised by presenting the fiber bundles with one of their extremities in a mould, whereby the fiber bundles are extending through the holder, and subsequently, either or not after having carried out one or more intermediate steps, by injecting synthetic material in the mold or mould in order to form at least a portion of the brush body.

By using a step-by-step working method for providing the fiber bundles in the carrier, a systematic filling is obtained which allows for a large number of applications, whereby, during the provision of fiber bundles in a carrier, it is easy to supply successively fiber bundles with different fibers, amongst others of different kind, colour or dimensions, to the carrier.

As use is made of a carrier which, in itself, does not fulfil any shaping function for the brush body and which cooperates with a holder, the requirements set for such carrier are less stringent, as a result of which it can easily be manipulated and can be manufactured in a very simple manner.

The use of a fiber bundle take-up device which, when passing alongside a fiber magazine, takes up fibers by means of a recess, either adjustable in size or not, in the take-up device, has as an advantage that it is possible to work at high speeds, which is very important within the scope of the method according to the present invention, considering that the carrier has to be filled step-by-step.

According to the invention, the afore-mentioned holder preferably consists of a wall or a wall portion of the mould itself.

However, according to an alternative it is not excluded that the holder consists of a pre-shaped portion of the brush body which, together with the fiber bundles extending through this portion, is placed into the mould, whereby the brush body is further completed by injecting synthetic material in the mould, during which the extremities of the fiber bundles are embedded into the injected synthetic material.

The separated fiber bundles preferably are provided in the aforementioned openings of the carrier by means of a mutual positioning between each respective fiber bundle and the opening in which it has to be provided, and by subsequently pushing the fiber bundles into the aforementioned openings, which allows for a fast and easy to control systematic filling of the carriers.

More particularly, it is preferred that the separated fiber bundles are presented to the carrier at one location or a limited number of locations and that the carriers are positioned systematically with the respective openings opposite the aforementioned locations, which, in a practical form of embodiment, may be performed by placing the carriers on a positioning table, more particularly a table which can be positioned in two directions.

Preferably, carriers with through openings are applied, whereby the separated fiber bundles are pushed into the openings and, after the carrier is filled with fiber bundles and is presented to the aforementioned holder, the fiber bundles taken up in the fiber holder are removed from the openings in order to be placed directly or indirectly in the aforementioned holder, Hereby, preferably use is made of carriers in the form of transport plates or small blocks, whereby the openings consist of through bores.

Further, the fiber bundles provided in the aforementioned holder preferably are provided from each respective carrier in the aforementioned holder by pushing them out of the carrier by means of ejection pins, which increases the universality of the method, as, by different choice of the applied ejection pins, it is easy to obtain different effects, such as, for example, a profile at the free extremities of the brush hair.

In consideration of the fact that, according to the invention, carriers are applied which fulfil no shaping function for the formation of the brush bodies, it is possible to place additional accessories, for example, fiber guidances, between these carriers and the holders. Hereby, fiber guidances can be applied which serve for different purposes, such as the combining of fiber bundles, the displacement of fiber bundles, or the provision of the fiber bundles in the brush bodies at an angle.

The present invention also relates to a device which applies the aforementioned method and which consists in the combination of at least one fiber magazine with loose fibers; means for the lateral separation of fiber bundles from the fibers of the fiber magazine; a mechanism with at least one carrier in which openings are formed in which the aforementioned fiber bundles can be provided; and transfer means for presenting the carrier, carriers, respectively, filled with fiber bundles, to a holder by means of which holder the fiber bundles can be presented in a mould in an appropriate manner.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein:

FIGS. 18 to 22 represent different brush bodies which can be manufactured with the method according to the invention;

DESCRIPTION OF PREFERRED EMBODIMENTS

Figure 1:
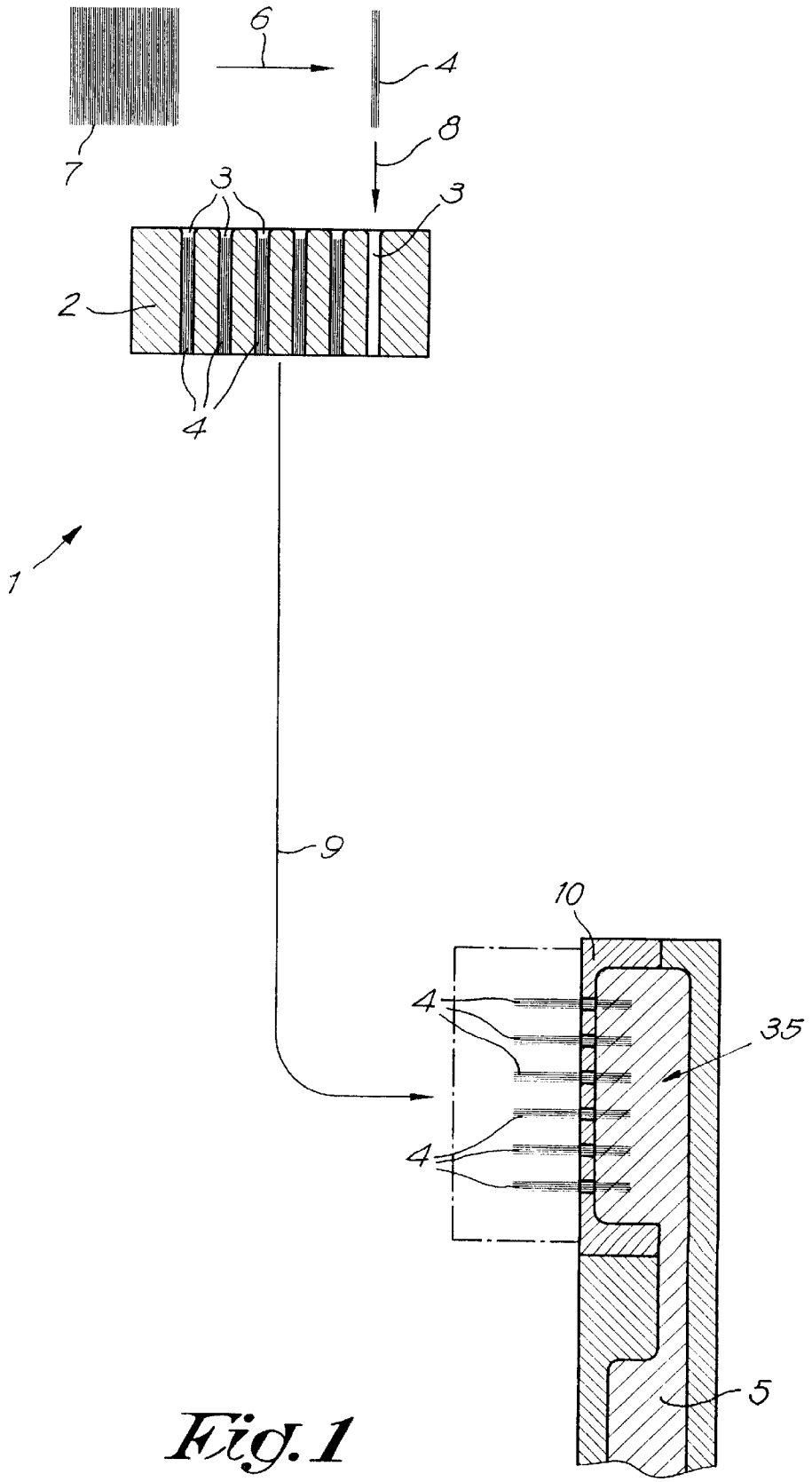
FIG. 1 schematically represents the method according to the invention.

In FIG. 1, the method according to the invention for manufacturing brushes is represented schematically, whereby for the supply of fibers, use is made of a device 1 with at least one carrier which is provided with openings 3 which are mutually arranged according to a certain pattern, whereby in this carrier 2, the fiber bundles 4 can be collected which have to be provided in a brush body 5.

Further, this method substantially consists in the combination of at least four steps, respectively, a first step 6 consisting in the lateral separation of fiber bundles 4 from at least one quantity of loose fibers 7; a second step 8 consisting in the step-by-step mechanical filling of the aforementioned carrier 2 with the aforementioned fiber bundles 4; a third step 9 consisting in the transfer of the fiber bundles 4 which are placed in the carrier 2 by means of this carrier 2 to a holder 10; and a fourth step 11 consisting in the fixation, by means of this holder 10, of the fiber bundles 4 in the brush body 5, or at least in a portion of the brush body 5.

The holder 10 represented in FIG. 1 consists of a wall portion or such of the mold or mould in which the fiber bundles 4 are provided in order to form subsequently at least one portion of the brush body 5 in this mould, for example, by casting, injection or such, whereby the extremities of the fiber bundles placed in the mould then become fixed automatically. It is noted that the fiber extremities protruding through the holder 10 eventually first may be attached to each other, for example, may be melted together, before the mould is filled with synthetic material.

For the lateral separation of the fiber bundles 4, as represented in FIGS. 2 to 5, use shall be made of at least one fiber magazine 12 and a fiber bundle take-up device 13 cooperating therewith which is moved along the fibers 7 provided in the fiber magazine 12, whereby this fiber bundle take-up device 13 is provided with a recess 14 in which fibers 7 can be taken up as this recess 14 passes alongside the fiber magazine 12.

Figure 2:
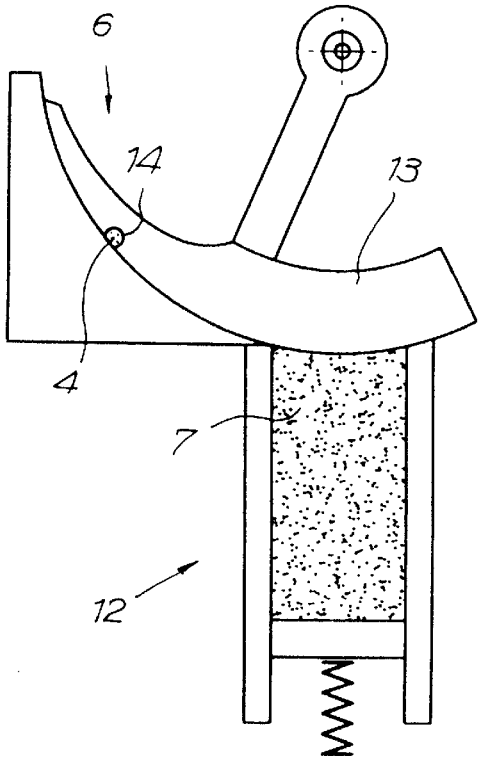
FIGS. 2 and 3 schematically represent means for the separation of fiber bundles.
Figure 4:
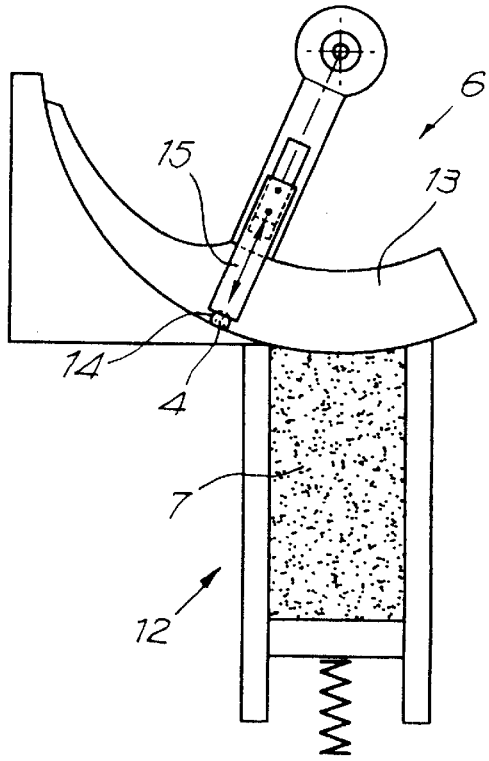
FIGS. 4 and 5 represent two particular forms of embodiment of the means depicted in FIGS. 2 and 3.
Figure 3:
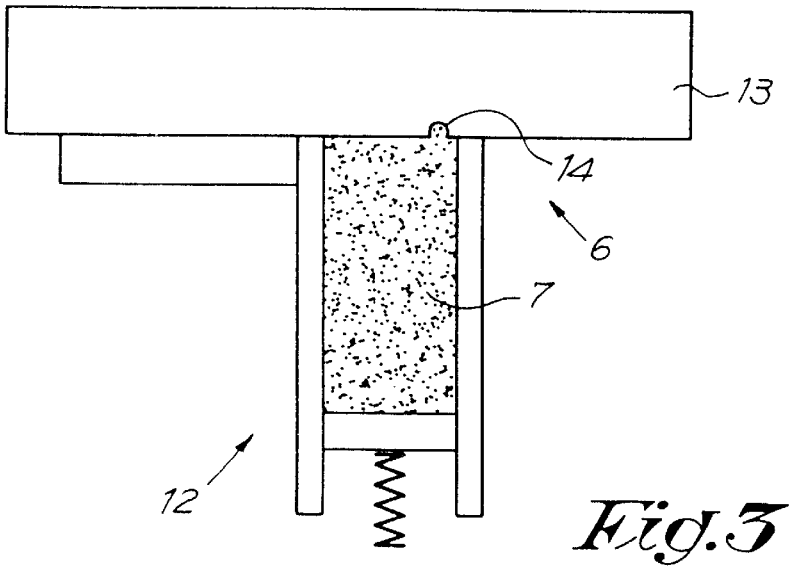
Figure 5:
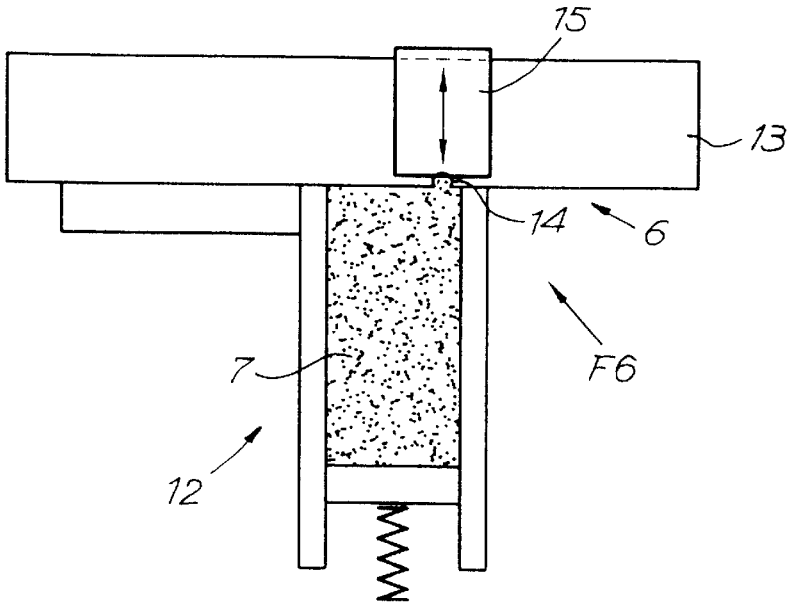
Figure 6:
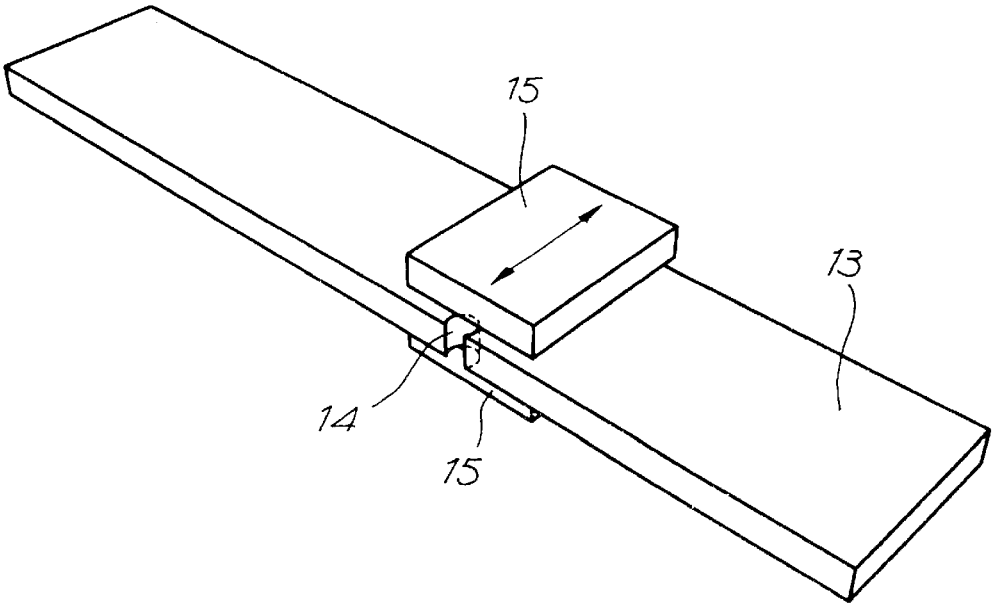
FIG. 6, at a larger scale and in perspective, represents a view according to arrow F6 in FIG. 5.

In the embodiment according to FIGS. 2 and 4, the fiber bundle take-up device is designed rotative, whereas in the embodiments according to FIGS. 3, 5 and 6, the fiber bundle take-up device 13 is designed straight.

In FIGS. 4, 5 and 6, it is represented in a schematic manner that the recess 14 in the fiber bundle take-up device 13 can be adjusted in size, by shifting a slide 15 or such, in order to take up more or less fibers off a magazine 12.

Figure 7:
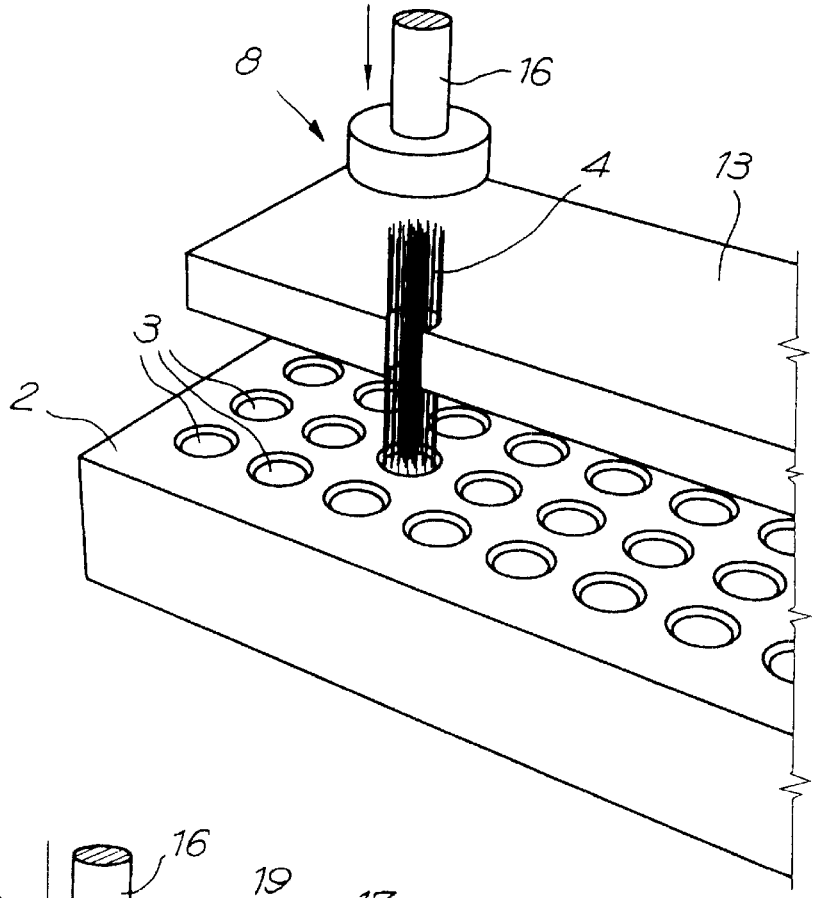
FIGS. 7 and 8 schematically represent how the separated fiber bundles can be placed in a carrier.
Figure 8:
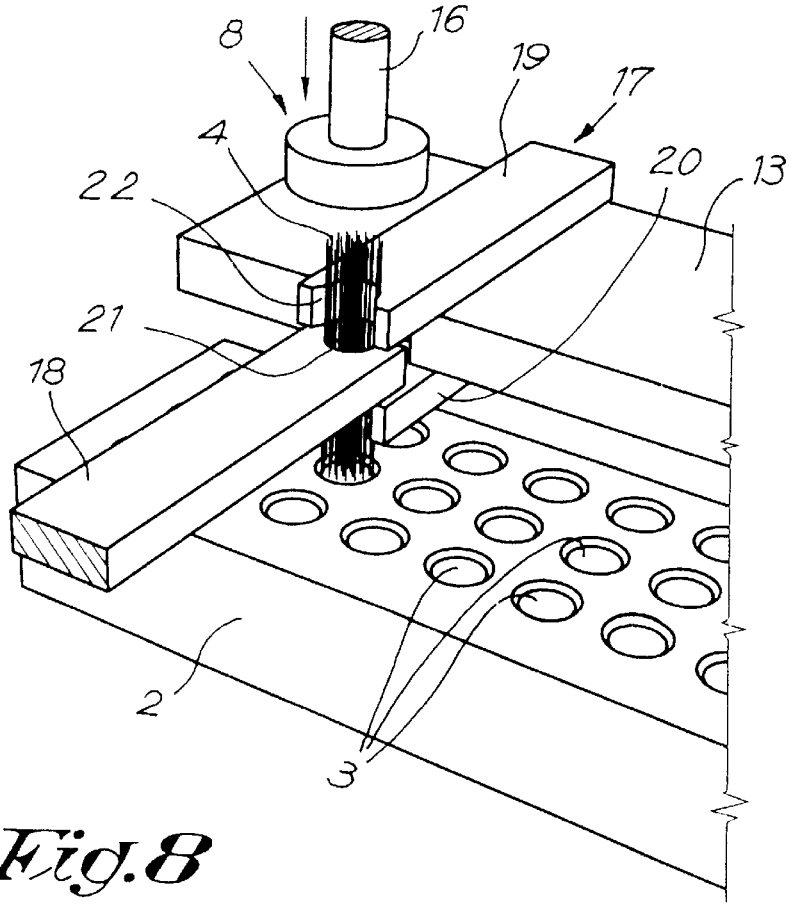

In FIG. 7, it is represented schematically that the separated fiber bundles 4 are brought into the openings 3 of the carrier 2 by positioning these fiber bundles 4 in an appropriate manner in respect to the respective openings 3 and subsequently pushing these fiber bundles axially into the respective openings 3, for example, by means of a punch 16.

In order to position the fiber bundles 4 even better in respect to the openings 3 of the carrier 2, use shall be made of transfer device or means 17 which, in this case, are formed by a central lath 18 and two exterior laths 19, 20, whereby the extremities thereof facing each other show recesses, respectively 21 for lath 18 and 22 for the laths 19 and 20, whereby in this case these recesses have a semicircular shape.

As the openings 3 may show other shapes than a cylindric shape, also the shape of the recesses 21 and 22 may correspond to the shape of the openings 3, in such a manner that the fiber bundles 4 which are separated by a fiber bundle take-up device 13 are pushed, by means of the laths 18, 19 and 20, into the appropriate shape before being inserted into the openings 3.

Figure 9:
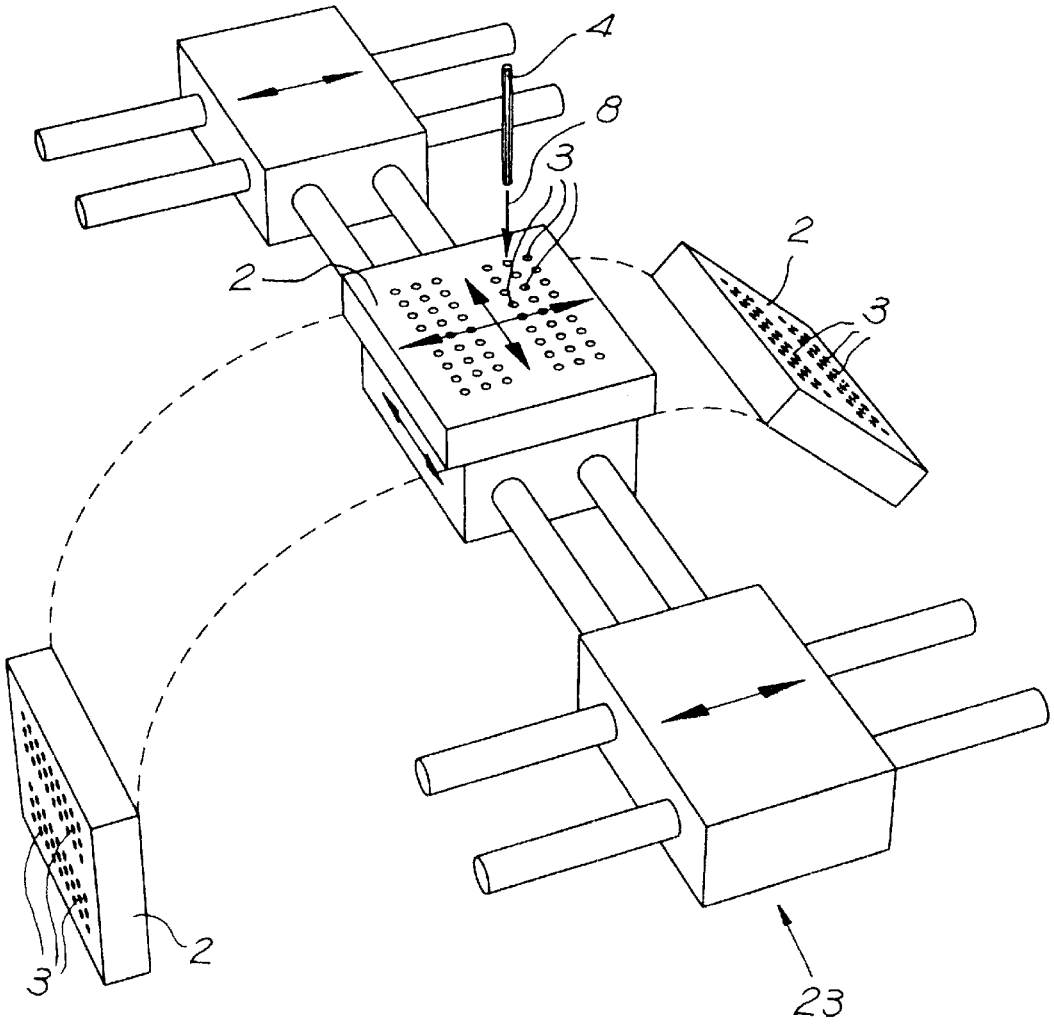
FIG. 9 schematically represents how different carriers successively can be filled with separated fiber bundles in a systematic manner.

In FIG. 9, a device is represented schematically whereby the carriers 2 are moved in an appropriate manner by means of a device 23, in longitudinal direction as well as in perpendicular direction, in order to bring the openings 3 thereof successively under a location where the fiber bundles 4 are removed from the fiber bundle separation device 13 in order to be provided in the openings 3 and thus providing successively a fiber bundle 4 in the different openings, whereby carriers 2 can be supplied to this device 23 one by one in an appropriate manner.

Figure 10:
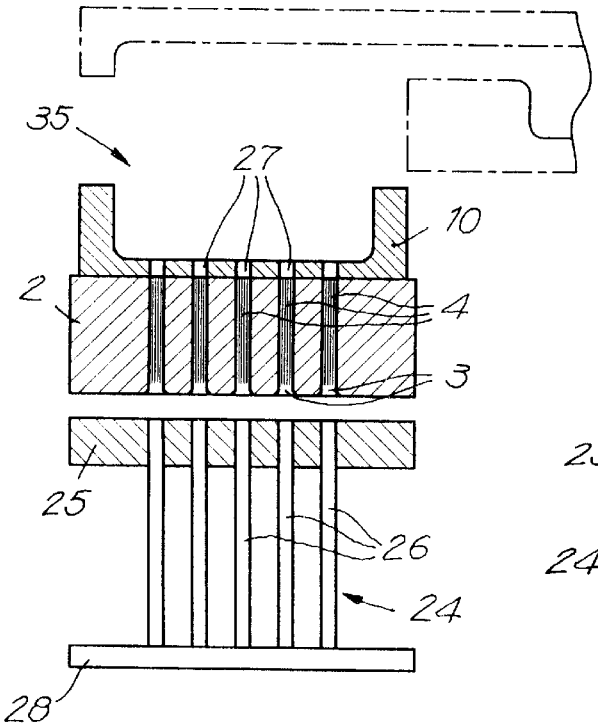
FIGS. 10 and 11 represent how the fiber bundles can be transferred from the aforementioned carrier into a holder.
Figure 11:
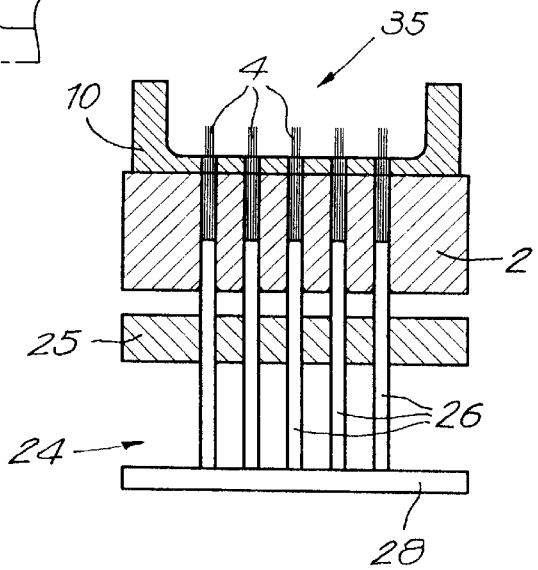

In FIGS. 10 and 11, an embodiment is represented schematically whereby a carrier 2 filled with fiber bundles 4 is brought against a holder 10 by means of transfer means not represented in the figures, and whereby at the other side of the carrier 2, a device 24 is provided which is intended for moving the fiber bundles 4 from the carrier 2 into the holder 10.

To this aim, this device 24 consists of a guidance plate 25 on which ejection pine 26 are provided, according to a pattern which corresponds to the pattern of the openings 3 in the carrier 2, the pattern of the holes, or openings or passages 27 provided in the holder 10, respectively, whereby these ejection pins 26 are attached, for example, on a common support 28.

It suffices, as represented in FIG. 11, to move the ejection pins 26 in the openings 3 of the carrier 2 in order to move the fiber bundles 4 into the holder 10, in such a manner that the free extremities of these fiber bundles 4 protrude from the aforementioned openings 27 with an appropriate length.

Figure 12:
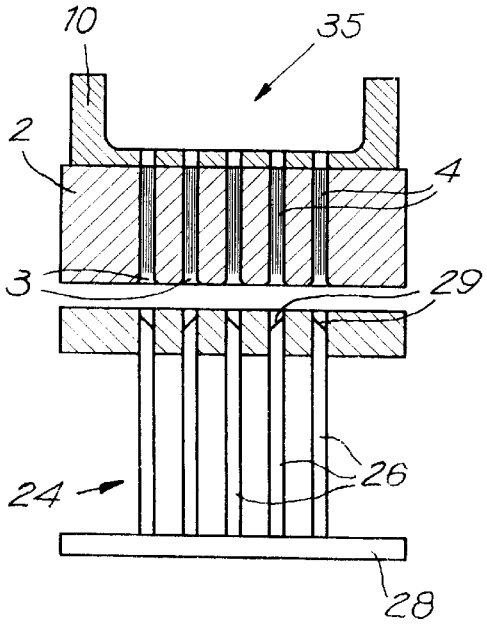
FIGS. 12 and 13 represent a variant of the embodiment according to FIGS. 10 and 11.
Figure 13:
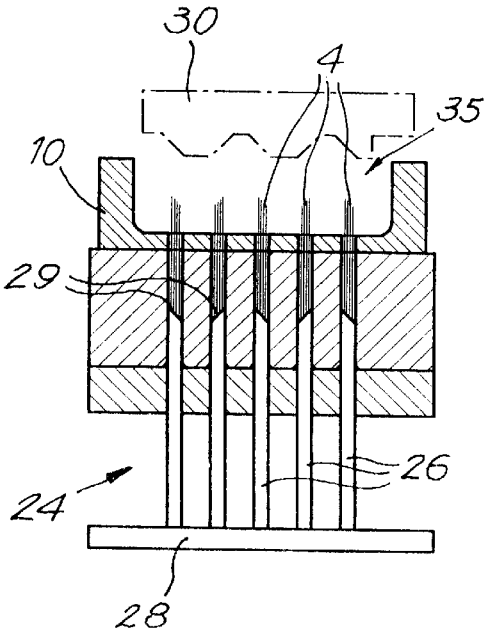

In FIGS. 12 and 13, an embodiment is represented similar to that of FIGS. 10 and 11, but whereby the ejection pins 26 show an inclination 29 at their free extremity, in such a manner that the fiber bundles 4 are positioned in the holder 10 corresponding to the inclinations 29.

In dash-dot line, a pressure element 30 is represented in FIG. 13 with which the same result can be obtained, by treating the fiber bundles 4, after their insertion into the holder 10, by beating thereupon and/or subjecting them to a vibration in order to obtain the appropriate end position. This pressure element 30 may also be applied in combination with the ejection pins 26, as a beating element for positioning the fibers against the extremities of the ejection pins 26.

Finally, by varying the length of the pins 26, the fiber bundles shall be brought more or less into the holder 10, as a result of which, in this respect, too, a certain profile of the extremities of the fiber bundles can be obtained.

Figure 14:
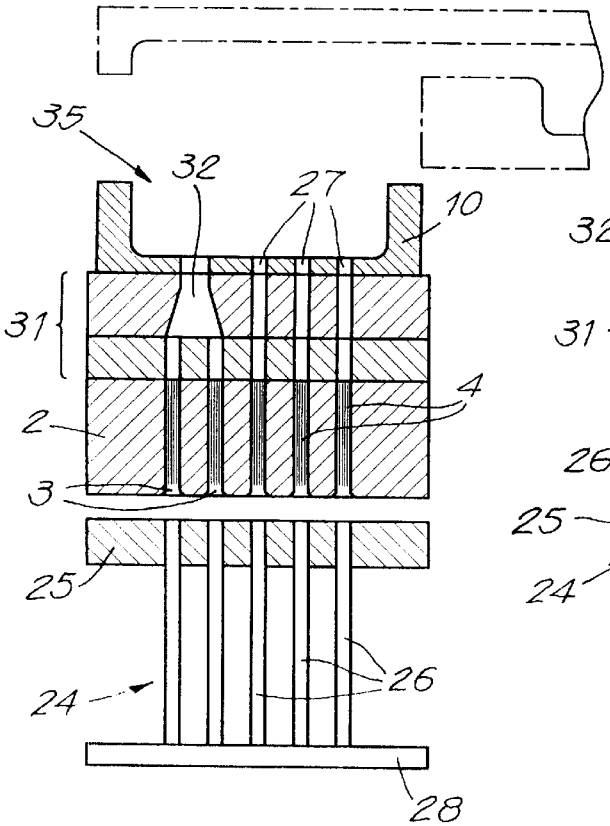
FIGS. 14 and 15, in two positions, represent an embodiment whereby use is made of an additional fiber guidance.
Figure 15:
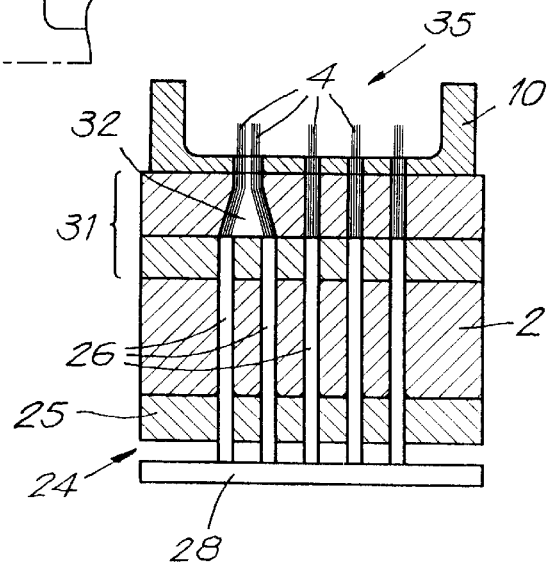

In FIGS. 14 and 15, an embodiment is represented whereby between the carrier 2 and the holder 10 a fiber guidance 31 is provided which is intended, as becomes clear from the drawings, to bring together two or more fiber bundles 4 in the holder 10, by means of a, for example, funnel-shaped guidance 32.

Figure 16:
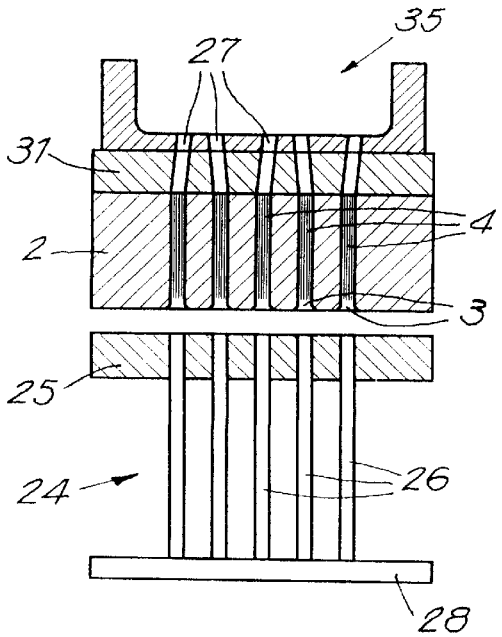
FIGS. 16 and 17 represent a variant whereby another fiber guidance is used.
Figure 17:
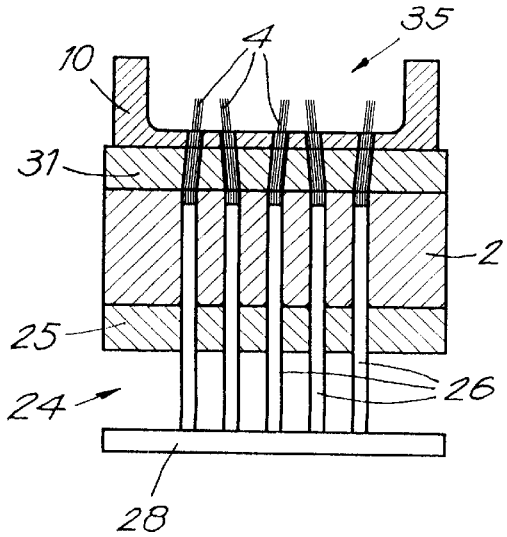

In the embodiment according to FIGS. 16 and 17, the fiber guidance 31 has as a function to guide the fiber bundles 4 to another location, whether or nor with the intention of placing these fiber bundles in the holder 10 at a certain angle.

In FIGS. 18 to 22, examples of, in this case, toothbrushes are represented schematically, whereby, in accordance with the aforementioned manner, the fiber bundles 4 are provided in an appropriate manner, in order to realize certain patterns in the horizontal plane as well as in the vertical plane.

In FIG. 22, a particular embodiment is represented whereby at certain locations, by the combination of fiber bundles, certain continuous fiber bundle arrangements are obtained.

Figure 23:
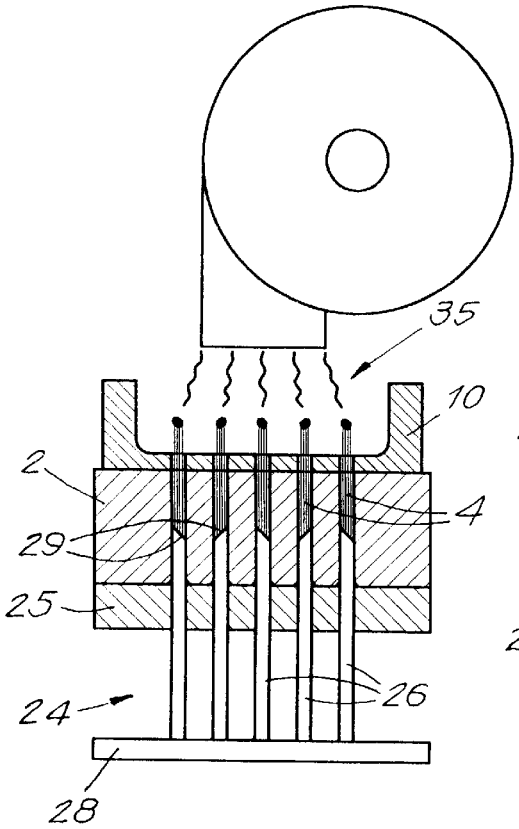
FIGS. 23, 24 and 25 schematically represent a number of possibilities for fixing the fiber bundles in a holder.

When the fiber bundles 4, in the manner as described in the aforegoing, are provided in a holder 10, the free extremities of the fibers, as represented, for example, in FIG. 23, will preferably be melted together, for example, under the influence of heat, whereby it is obtained at the same time that, in this way, the fiber bundles are retained in the holder.

Figure 24:
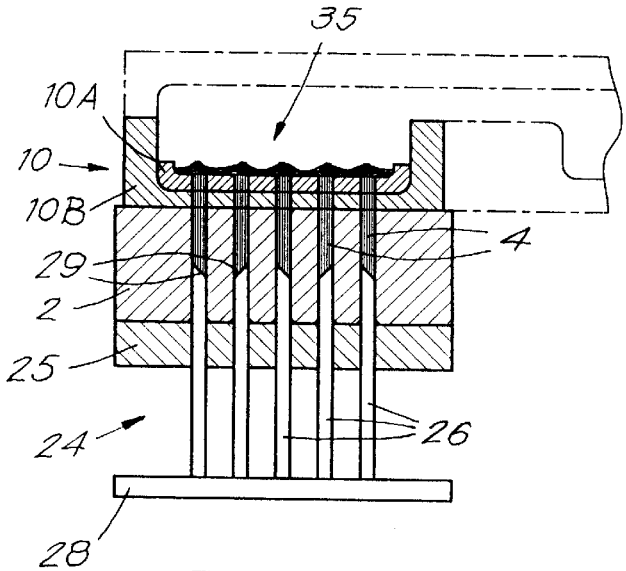

According to a variant, as represented in FIGS. 24, it is also possible to bring a pre-shaped or pre-formed portion 10A of the brush body in the mould, which in that case, together with the portion 10B of the mould, forms a composed holder 10.

This allows that the fiber bundles protruding in the holder 10 can be chosen with such a length that not only the fibers of a single fiber bundle are melted together, but, at the same time, the fibers of adjacent fiber bundles are connected to each other, such that one whole is obtained which, in heated condition, preferably is compressed.

Figure 25:
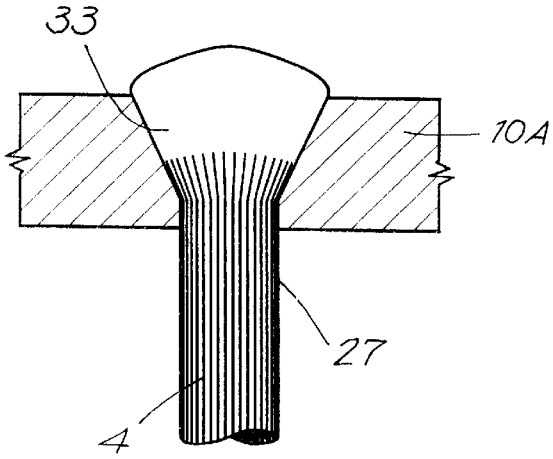

In a particular embodiment, as represented in FIG. 25, the openings 27 in the holder 10 will show an enlargement 33, as a result of which the fiber bundles 4 are additionally fixed in the openings 25.

Figure 26:
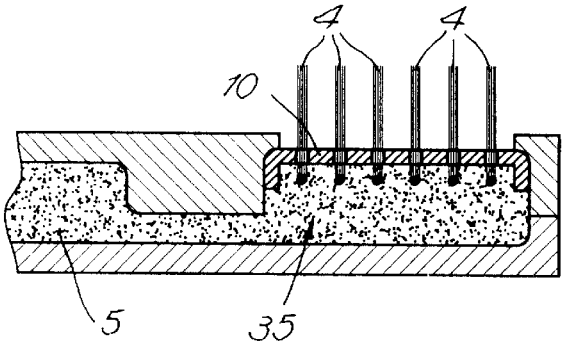
FIGS. 26 to 28 schematically represent three alternative embodiments.

FIG. 26 shows a variant of the embodiment of FIG. 25, whereby the abovesaid portion 10B is omitted and, consequently, the holder 10 only consists of the pre-shaped or pre-formed portion of the brush body 5.

It is obvious that, instead of using a mould for the complete brush body 5, it is also possible to use a mould for only a portion 34 of the brush body 5. The pre-formed portion 34 can then be fixed to the remaining portion of the brush body 5, as schematically indicated with arrow P1 in FIG. 27, either by the manufacturer or by the consumer, by means of any suitable technique, for example by clicking or welding.

Figure 27:
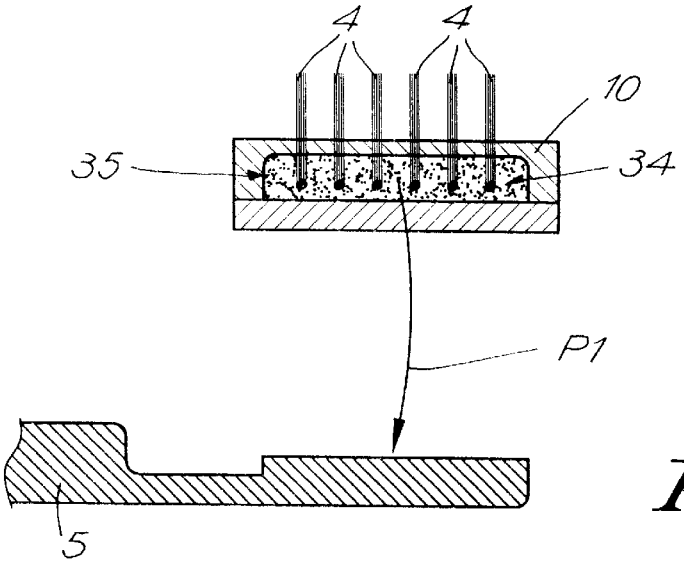
Figure 28:
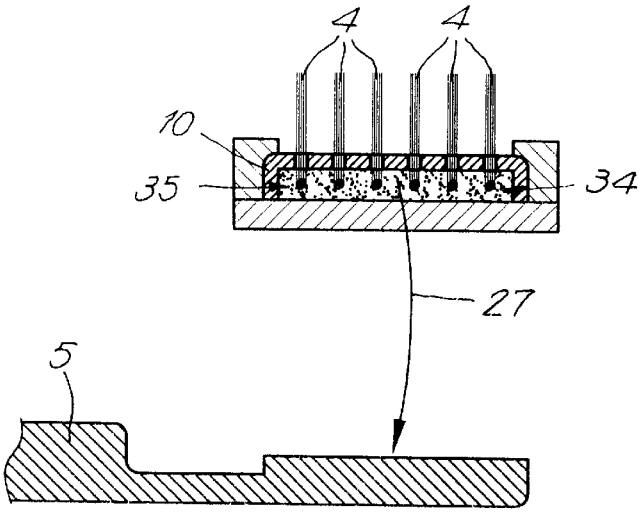

FIG. 28 shows a variant in which a combination is made of the techniques shown in FIGS. 26 and 27, in other words, before forming the portion 34, a holder 10 consisting of a pre-formed portion of the brush body is provided in the mould.

It is clear that in all embodiments of the FIGS. 10 to 17, 23, 24 and 26 to 28, the holder 10 always forms part of the mould or borders the cavity of the mould, whereby, according to this invention, it is always intended by reference 35, is filled up by injecting synthetic material in it by injection moulding.

The present invention is in no way limited to the embodiments described heretofore and represented in the drawings, on the contrary, devices applying the method according to the invention may be realized in a variety of forms and dimensions without leaving the scope of the invention.

What is claimed is:

1. A method for manufacturing brushes, comprising:

providing a device comprising at least one carrier (2) with openings (3) which are mutually arranged according to a certain pattern;

separating laterally fiber bundles (4) from at least one quantity of loose fibers (7);

inserting in a mechanical manner, step-by-step, of the fiber bundles (4) in the carrier (2);

transferring extremities of the fiber bundles (4) which are placed in the carrier (2) to a holder (10) and fixing the fiber bundles (4) in at least a portion of the brush body, by presenting the fiber bundles (4) with one of their extremities in a mould, whereby the fiber bundles (4) are extending through the holder (10); and subsequently after having carried out one or more of the steps above, injecting synthetic material in the mold and forming at least a portion of the brush body (5).

2. The method according to claim 1, wherein, in the step of separating the fiber bundles (4), at least one fiber magazine (12) and a fiber bundle take-up device (13) cooperate together such that the fiber bundle take-up device (13) is moved along the fibers (7) of the fiber magazine (12), the fiber bundle take-up device is provided with a recess (14) to receive the fibers (7), that fiber bundles (4) are separated from the fiber magazine (12) and are subsequently provided in the carrier (2).

3. The method according to claim 1, wherein, in the step of separating the fiber bundles (4), the thickness of the separated fiber bundles (4) is changeable and controlled according to a particular cycle, by using a bundle take-up device (13) having a recess into which at least one fiber bundle (4) is separated from the loose fibers (7), and the size of the recess (14) being adjusted.

4. The method according to claim 1, wherein, in the step of inserting the fiber bundles (4) to the holder (10), the separated fiber bundles (4) are positioned in the openings (3) of the carrier (2) by positioning each of the respective separated fiber bundles (4) into a respective one of the openings (3), and subsequently pushing the separated fiber bundles (4) into the openings (3).

5. The method according to claim 4, wherein, the step of separating fiber bundles (4) is performed by a fiber bundle take-up device (13), in the step of inserting the fiber bundles (4) in the carrier (2), and the fiber bundles (4) are pushed from the fiber bundle take-up device (13) immediately into the openings of the carrier (2).

6. The method according to claim 4, wherein, the step of separating fiber bundles (4) is performed by a fiber bundle take-up device (13) in the step of inserting the fiber bundles (4) in the carrier (2), and the separated fiber bundles (4) are positioned in respective openings of the carrier (2) by a transfer device (17) positioned adjacent the carrier (2) that transfers fiber bundles (4) from the fiber bundle take-up device (13) and in the openings (13).

7. The method according to claim 1, wherein, the openings (3) of the at least one carrier (2) are shaped differently in the cross-section of the separated fiber bundles (4) and the separated fiber bundles (4), in respect to their cross-sections are re-shaped during the transfer to the carrier (2) in order to obtain a shape which is adapted to the different shapes of the respective openings (3).

8. The method according to claim 1, wherein, in the step of inserting the fiber bundles (4) in the carrier (2), the separated fiber bundles (4) are presented to the carriers (2) on at least one or more well-defined locations and the respective carriers (2) are subjected to a positioning cycle such that the separated fiber bundles (4) are systematically presented to the openings (3) of the carriers.

9. The method according to claim 1, wherein, in the step of transferring fiber bundles (4) the separated fiber bundles (4) are pushed into the openings (3) of one or more of the at least one carrier (2) and, after the carrier (2) is filled with fiber bundles (4) and has been presented to a holder (10), the fiber bundles (4) taken up in the carrier (2) are removed from the openings (3) in order to be placed directly or indirectly into the holder (10).

10. The method according to claim 9, wherein, in the step of transferring the fiber bundles (4), the fiber bundles (4) positioned in each of the at least one carrier (2) are brought from the carrier (2) into the respective holder (10) by pushing the fiber bundles (4) out of the carrier (2) with ejection pins (26).

11. The method according to claim 1, wherein, in the step of fixing the fiber bundles (4), the fiber bundles (4) with their extremities which are intended to form free extremities of brush hair, are arranged according to a desired profile.

12. The method according to claim 1, wherein, in the step of transferring the fiber bundles (4), a fiber guidance (31) is provided which either places some of the fiber bundles (4) in a well-defined direction, brings some of the fiber bundles (4) together or guides some of the fiber bundles (4) to another location, or any combination thereof.

13. The method according to claim 1, wherein, the holder (10) comprises a wall portion of a mold in which the fiber bundles (4) are provided at one of their extremities, and whereby subsequently in said mould at lest a part of a brush body (5) is formed.

14. The method according to claim 1, wherein the holder (10) comprises an already previously formed portion (10A) of the brush body (5) which is provided in the mold.

15. The method according to claim 1, wherein the holder (10) comprises a portion that is provided with through openings (27), and in the step of fixing the fiber bundles (4), the fiber bundles (4) with their respective extremities are brought through the openings (27) of the holder (10), the extremities of fiber bundles (4) protruding through the portion of the holder (1) are subsequently adhered to each other and/or fixed in the respective portion of the older (10).

16. The method according to claim 15, wherein, the extremities of the fiber bundles (4) which protrude through the portion of the holder (10) are subjected to a technique selected from a group consisting of melting together of the fibers (7) by heat, melting to each other of the fiber bundles (4) by heating and flattening the respective extremities, and sealing of the fibers (7), at least next to a foot at which they protrude through the holder (10).

17. A device for manufacturing brushes, comprising:

at least one fiber magazine (12) with loose fibers (7);

a separator that laterally separates fiber bundles (4) from the loose fibers (7) of the fiber magazine (12);

at least one carrier (2) having openings that are arranged according to a certain pattern;

a mechanism that inserts the fiber bundles (4) into the openings in a step-by-step, mechanical manner; and a transfer device connected to the at least one carrier and configured to transfer the at least one carrier (2), filled with the fiber bundles (4), to a holder (10), whereby the fiber bundles (4) can be presented in a mold.

18. The device according to claim 17, wherein, the fiber bundle take-up device (13) for the lateral separation of fiber bundles (4) comprises a to-and-fro movable fiber bundle take-up device (13) which is provided with a recess (s14);

the carrier (2) comprises a plate with through openings (3); and the device further comprises a moving device (24) in the form of ejection pines (26) that transfer the fiber bundles (4) from the carrier (2) to the holder (10).

* * * * *